United States Patent [19]

Dobrzanski

[11] 4,401,979

[45] Aug. 30, 1983

[54] ELECTRICAL CONTROLS FOR IONIZATION SMOKE DETECTOR

[75] Inventor: John J. Dobrzanski, New Britain, Conn.

[73] Assignee: General Signal Corporation, Stamford, Conn.

[21] Appl. No.: 233,539

[22] Filed: Feb. 11, 1981

[51] Int. Cl.[3] ..... G08B 17/10

[52] U.S. Cl. ..... 340/629; 340/628; 250/381; 250/384

[58] Field of Search ..... 340/628, 629; 250/381, 250/384, 389

[56] References Cited

U.S. PATENT DOCUMENTS

| | | | |
|---|---|---|---|
| 3,665,441 | 5/1972 | Suchomel et al. | 340/629 |
| 3,688,119 | 8/1972 | Kobayashi | 340/629 |
| 3,792,279 | 2/1974 | Sasaki | 340/629 |
| 3,812,362 | 5/1974 | Larsen et al. | 340/629 |
| 3,909,815 | 9/1975 | Gacogne | 250/381 |
| 3,913,082 | 10/1975 | Hamm | 250/384 |
| 4,238,788 | 12/1980 | Rosauer et al. | 340/629 |

OTHER PUBLICATIONS

"Adjustable Shunt Regulators", Texas Instruments Bulletin No. DL-S 12414, Sep. 1977.

*Primary Examiner*—Gerald L. Brigance
*Attorney, Agent, or Firm*—John Ohlandt; Milton E. Kleinman; George W. Killian

[57] ABSTRACT

An ionization smoke detector device including means for insuring that adjustment can be made in the triggering potential for the alarm device so that should circumstances change, an operator can make a simple adjustment to take into account the changed circumstances. This means comprises a programmable Zener diode which is connected to a voltage dividing resistance network at the output of a field effect transistor, the other end of the Zener diode being connected to the input of a silicon controlled rectifier device which functions to trigger the alarm.

Another primary feature of the present invention is the provision of a means for testing the operation of the system in such a way that all of the elements of the system will be tested rather than merely some of them.

2 Claims, 3 Drawing Figures

Fig. 1.
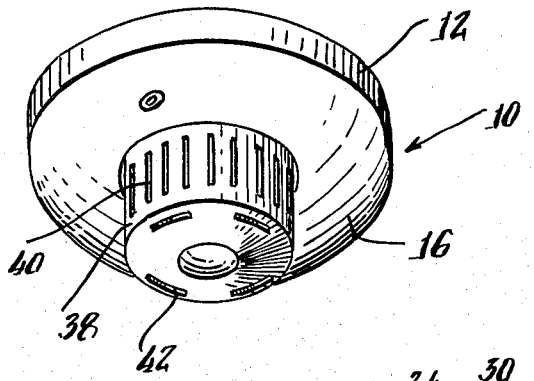
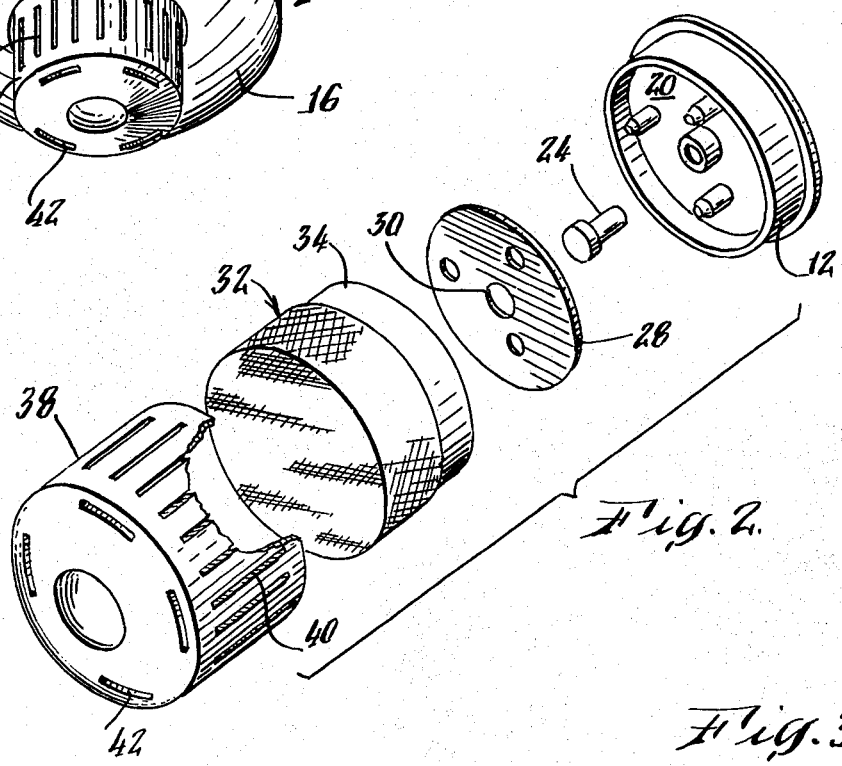
Fig. 2.
Fig. 3.
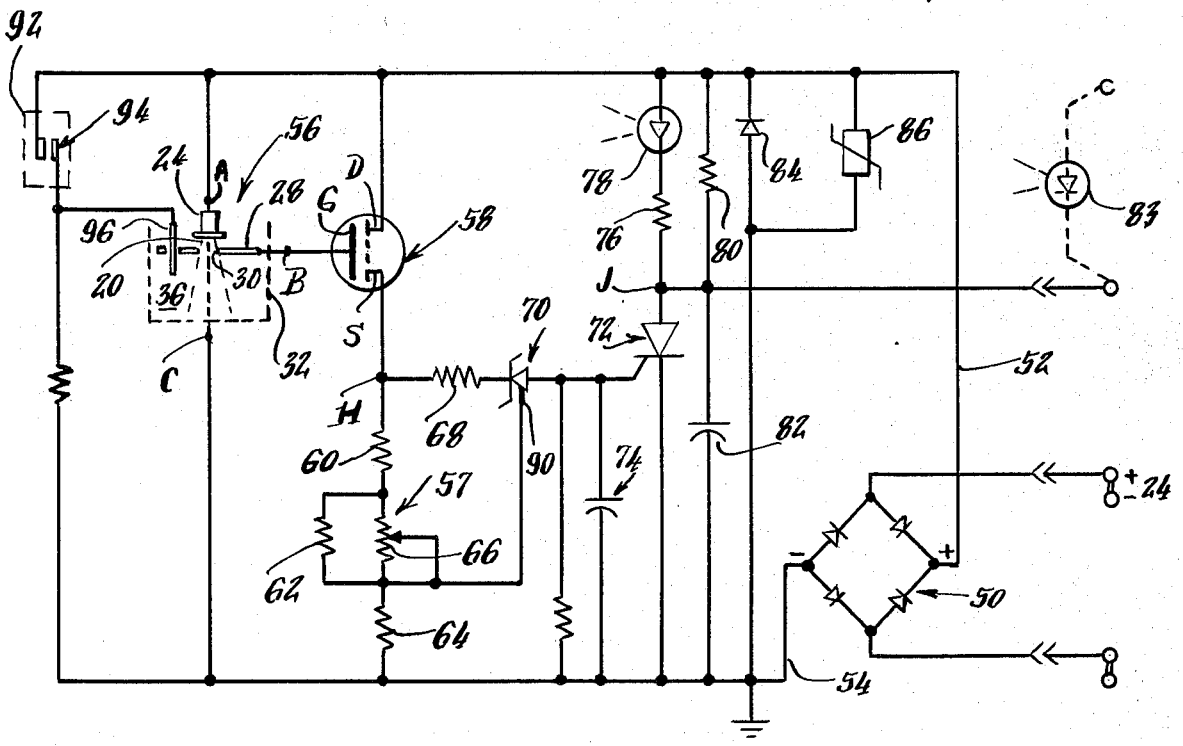

ELECTRICAL CONTROLS FOR IONIZATION SMOKE DETECTOR

BACKGROUND OF THE INVENTION

1. Field of the Invention

This invention relates to an ionization smoke detector device or system, and more particularly, to improvements in the operation of that class of smoke detector devices which are arranged to have a radioactive source and at least one ionization chamber irradiated by such source.

A variety of ionization smoke detectors have been developed over the past several decades. One form of such detector includes a pair of ionization chambers connected in series between the terminals of a voltage source and each having a pair of electrodes and a radioactive source in each chamber. Typically, one chamber is open to the ambient atmosphere so as to allow smoke to enter; this is sometimes referred to as the open chamber; while the other chamber is closed to the ambient.

Another type or form of ionization smoke detector provides for a single ionization chamber subdivided into two regions, with one of the regions, which is defined by an intermediate electrode and an outer electrode, having a much greater volume than the other region, which is defined in common by the same intermediate electrode and by an inner electrode.

In either type of smoke detector noted above, it is conventional to provide a field effect transistor having a gate electrode connected to the intermediate electrode located at the junction between the chambers or regions; and to have the source-drain conduction path connected between the terminals of a voltage source, which is also connected across the inner and outer electrodes of the detector. The field effect transistor operates to sense a potential change at the junction of the two chambers or regions so that when smoke enters the detector chamber, the change of potential resulting from a change of impedance in the chamber, causes substantial sourcedrain conduction of the field effect transistor. The transistor conduction, in turn, triggers an alarm device to give a suitable indication of the presence of smoke.

2. Background Art

In order to appreciate the objects and purposes of the present invention, reference may be made to the following U.S. Pat. Nos. considered useful in providing background information: 3,935,466; 3,935,492; 4,044,263.

What has been lacking in the prior art ionization devices is a suitable means or arrangement for providing complete control over the detector or alarm system. That is to say, for controlling and selecting a range of potentials over which a suitable signal can be given to produce an alarm output.

Another deficiency that the present invention is directed to overcoming is the lack of a means for efficiently and thoroughly testing the operation of the detector system so as to insure that the system is in good working order. In other words, one wants to be able to simulate the presence of smoke so as to determine whether or not the system will work efficiently should a smoke condition occur in the atmosphere.

Accordingly, the principal objects of the invention are to provide selective control of the triggering point for the alarm system and effective testing of the system.

SUMMARY OF THE INVENTION

In fulfillment of the above described principal objects, a first primary feature of the present invention resides in the provision of a means for insuring that adjustment can be made in the triggering potential for the alarm device so that should circumstances change, an operator can make a simple adjustment to take into account the changed circumstances. Specifically, this means takes the form of a programmable Zener diode which is connected to a voltage dividing resistance network at the output of a field effect transistor, the other end of the Zener diode being connected to the input of a silicon controlled rectifier device which functions to trigger the alarm. A variable resistor is included in the resistance network such that by suitable control thereof the operator can change the operating parameters for the Zener diode such that a variable triggering or firing potential can be selected.

Another primary feature of the present invention which fulfills the other principal object is the provision of a means for testing the operation of the system in such a way that all of the elements of the system will be tested rather than merely some of them. Previously known arrangements have performed tests to determine operability but have done so in such a way that a defect or fault in the detector itself, would not be measured. This is because the testing is done at such a place in the circuit that those possible faults would not be included.

The means for testing completely in accordance with the present invention comprises a voltage probe located in the ionization chamber and preferably adjacent the grid or intermediate electrode; a switch for applying a potential to the probe so as to simulate the effect of a voltage change normally resulting from the presence of smoke, such switch preferably taking the form of a magnetically operated switch, the switch contacts being inside the smoke detecctor housing. A remote magnet is brought adjacent those contacts so as to close them, thereby to establish a circuit to the probe.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is a perspective view of an ionization smoke detector in which the present invention is incorporated.

FIG. 2 is an exploded view of the smoke detector of FIG. 1.

FIG. 3 is a schematic diagram which illustrates the arrangements for testing the detector system and for controlling the triggering of an alarm device, all in accordance with the present invention.

DESCRIPTION OF PREFERRED EMBODIMENT

Referring now to the figures, there will be seen in FIGS. 1 and 2 the physical apparatus in which the features of the present invention are incorporated. A smoke detector 10 includes a base 12 for suitable mounting of the device, a shroud or housing 16 and a baffle means 38.

Referring specifically to FIGS. 2 and 3, the precise electrode arrangement in a physical sense can be appreciated by noting that a first, inner electrode 24 is affixed to the base 12 and is held within a region 20 of the ionization chamber. A second, intermediate electrode 28, having an opening 30, is retained at a fixed distance from the end of electrode 24; a third, screen electrode 32 defines the outer limits of the ionization chamber, being secured to the base 12 by ring 34. From an electrical standpoint, it can be seen by referring to FIG. 3 that the aforenoted electrodes are connected respectively to points A, B, and C in that figure.

The baffle means 38 seen in FIG. 2 is specially constructed in accordance with the invention of copending application U.S. Ser. No. 233,352, filed Feb. 11, 1981, assigned to the assignee of the present invention; such baffle means includes apertures 40 and 42 for the special purposes described therein. However, it should be noted that the present invention is not limited to the precise context of that copending application, but can be applied to other forms of ionization detectors.

Referring again to FIG. 3, it will be seen that for electrical operation of the system a source of potential, preferably plus or minus 24 volts, is connected to the terminal screws indicated at the lower right in FIG. 3. The arrangement is such that because of the bridge rectifier 50 included in the power supply circuit, either polarity can be applied to the input terminals and a positive potential will always appear on conductor 52, whereas a negative potential will appear on conductor 54.

The output voltage of bridge rectifier 50 is connected across the inner electrode 24 and the outer electrode 32 of the detector device 56 at the points A and C respectively. The same voltage is likewise seen to be applied to the drain electrode D and, by way of a resistance network 57, to the source electrodes of a field effect transistor 58. This resistance network 57 includes a series connection of three resistors 60, 62, and 64. Connected in shunt with the fixed resistor 62 is a variable resistor 66.

It should be noted that the intermediate electrode 28 is connected from the junction point B, seen at the upper left of FIG. 3, to the gate electrode G of field effect transistor 58. The potential of electrode 28 is, in conventional operation, the monitored potential and when this potential changes, due to the presence of smoke, the gate electrode of the field effect transistor 58 causes substantially greater conduction such that the potential at output point H will rise significantly. When this potential is sufficient, the Zener diode conventionally used will break down, causing the SCR, or other bistable device, to which it is connected, to go into its conductive state.

In accordance with the present invention, connection is made from output point H, by way of resistor 68, to the cathode of a programmable zener diode 70. The characteristics of such device may be appreciated by reference to Texas Instruments Voltage Regulator Handbook 1977, p. 125. This device has its anode connected to the gate of a silicon controlled rectifier 72. Also connected to the gate of SCR 72 is a resistor and capacitor network 74, the cathode of the SCR being connected to ground and the anode thereof being connected, by way of a resistor 76 and an output alarm device 78, in the form of an LED, to positive line potential.

The output point J at the anode of SCR 72 is taken to the junction between a by-pass resistor 80, and shunt capacitor 82, the latter serving to protect the SCR from false firing during sudden changes in voltage; the point J is also connected to a remote LED 83 so that an alarm may be given at such remote point. Further connected across the power supply and in shunt with each other are a diode 84 for decoupling radio frequencies, and varistor 86 for protecting against high voltage transients.

In the operation of the system of the present invention, it will be understood that smoke entering the ionization chamber will be present in both region 20 and region 36, the latter being much larger in volume than the former. Accordingly, the impedance change that takes place is very large in the outer region 36 and, therefore, there is a significant change in potential at the intermediate electrode 28 and hence at the gate G of field effect transistor 58. Consequently, the source-drain current of that field effect transistor 58 increases, with an attendant positive potential increase at the output point H.

A primary feature of the invention resides in the precise arrangement and connection of the programmable zener diode 70 so as to be able to selectively vary the triggering point for the alarm over a wide range of input conditions. Thus, depending on the value selected for the resistance network 57, the programmable zener diode 70 will break down over a range of potentials. It will be understood that the programmable zener diode 70 exhibits a family of breakdown characteristics any one of which may be selected by altering the potential at the gate electrode 90 thereof. Thus, control is established over that range of firing or breakdown potentials by reason of the network 57 which includes the variable resistance 66, such that changing this resistance will change the bias between gate and cathode. Conventionally, with a 4% smoke obscuration one wants to be certain that a normal zener diode would fire and produce an alarm signal. However, under certain unusual circumstances, such as background pollutants, for example, being present in the ambient one might want to raise this percentage and correspondingly raise the firing point. This may be accomplished by varying the value of the resistor 66 in the present circuit.

The other primary feature of the present invention resides in an arrangement including a magnetic switch 92 seen at the upper left in FIG. 3. When a test is to be made, a magnet of some kind is brought near the point within the casing or housing where the contacts 94 are located, thereby to close the contacts. Smoke simulation is achieved due to the connection and arrangement of a probe 96 which, as can be seen, is disposed in close proximity to electrode 28, for example through an opening therein.

In operation, that is, in testing the system, the probe 96 will provide a potential in the ionization chamber when the power supply is connected by magnetic actuation of contacts 94. As a result, there will be the same effect present as if smoke were in the chamber since the potential on probe 96 will effectively increase the potential appearing on the gate electrode of field effect transistor 58.

It will be appreciated that no physical movement is involved in testing the system by simulating smoke presence in this way. Instead, the only action taking place is the deliberate introduction of an added potential to the chamber, with the resultant change in chamber characteristics. The significant advantage of this probe scheme, in addition to the lack of need for movement in the chamber, is that the testing is being imposed at the initial stage in the system, that is, within the chamber itself rather than at some subsequent stage in the system.

Consequently, all of the component parts are being tested.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. An ionization smoke detector system comprising:

(a) a voltage source;

(b) a detector device having a first, inner electrode; a second, intermediate electrode; and a third, outer electrode;

(c) a field effect transistor having source, drain, and gate electrodes, said field effect transistor being connected to said voltage source;

(d) said second electrode of said detector device being connected to the gate electrode of said field effect transistor, said first and third electrodes of said detector device being connected across said voltage source;

(e) an alarm device, and a silicon controlled rectifier connected to said alarm device and being operable to actuate said alarm device when sufficient threshold voltage is present at the gate electrode of said silicon controlled rectifier;

(f) a programmable Zener device having anode, cathode, and gate electrodes;

(g) an output point connected to the source electrode of said field effect transistor, a fixed, current-limiting resistor connected between said output point and the cathode of said programmable Zener device, such that the potential at the output point is fully applied to said Zener device, the anode of the Zener device being connected to the gate electrode of said silicon controlled rectifier, whereby when the potential at said output point rises sufficiently, responsive to smoke in said detector, said Zener device breaks down so as to produce conduction in said silicon controlled rectifier, said Zener device normally not being in a breakdown condition;

(h) a voltage dividing resistance network, connected at one end to said output point and at the other end to reference potential, for selecting a breakdown or threshold voltage for said programmable Zener device, said network comprising three resistors, at least one of which is a variable resistor;

(i) said variable resistor being connected to the gate electrode of said programmable Zener device to vary slightly the potential thereat so as to adjust the breakdown or threshold voltage for said programmable Zener device.

2. A detector system as defined in claim 1, in which a fifth, fixed, resistor is connected across said variable resistor.

* * * * *